United States Patent [19]

Stelzner et al.

[11] 4,240,239

[45] Dec. 23, 1980

[54] METHOD AND DEVICE FOR THE INSERTION OF CANS INTO CARRIERS

[75] Inventors: Herbert A. Stelzner, Kaarst; Peter Lau, Leichlingen, both of Fed. Rep. of Germany

[73] Assignee: Plastik-und Metallverpackung GmbH, Dusseldorf-Holthausen, Fed. Rep. of Germany

[21] Appl. No.: 959,936

[22] Filed: Nov. 13, 1978

[51] Int. Cl.[3] ..... B65B 21/00

[52] U.S. Cl. ..... 53/398; 53/48

[58] Field of Search ..... 53/398, 48, 134, 413, 53/446

[56] References Cited

U.S. PATENT DOCUMENTS

| | | | |
|---|---|---|---|
| 2,929,181 | 3/1960 | Poupitch | 53/398 |
| 3,190,434 | 6/1965 | Dardaine | 53/48 X |
| 3,242,631 | 3/1966 | Whiteford | 53/441 X |
| 3,383,828 | 5/1968 | Cunningham | 53/48 X |
| 3,407,563 | 10/1968 | Dieter et al. | 53/48 X |

FOREIGN PATENT DOCUMENTS

| | | | |
|---|---|---|---|
| 2724583 | 12/1978 | Fed. Rep. of Germany | 53/48 |

*Primary Examiner*—Horace M. Culver

*Attorney, Agent, or Firm*—Hammond & Littell, Weissenberger and Muserlian

[57] ABSTRACT

A method and apparatus for packaging cans or similar objects having beaded rims in combination with planar carriers of polymeric materials is described. The cans are arrayed into groups corresponding to rim-engagingo openings or formations on the carriers by a conveyor and the cans are then positioned, aligned and firmly held with respect to the formations by cores inserted into the interstices within the array. The cores are actuated by the position of the conveyor belt via rails at specific stations. While the cores are holding the cans in alignment with respect to the carrier, the cans are inserted into the carriers by conveyor-actuated rams so that the beads on said rims engage the formations on the carriers. The carriers may include the rim-engaging formations along opposite faces.

10 Claims, 5 Drawing Figures

FIG. 4
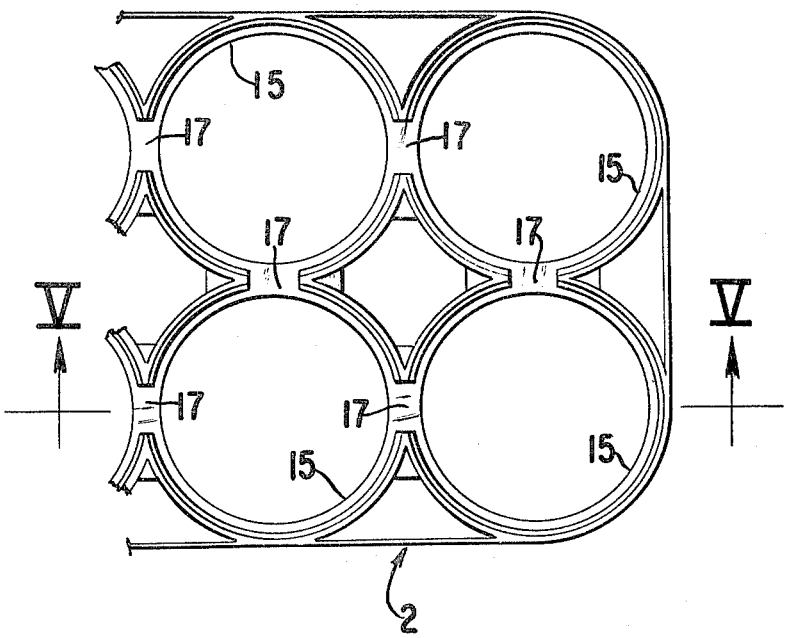
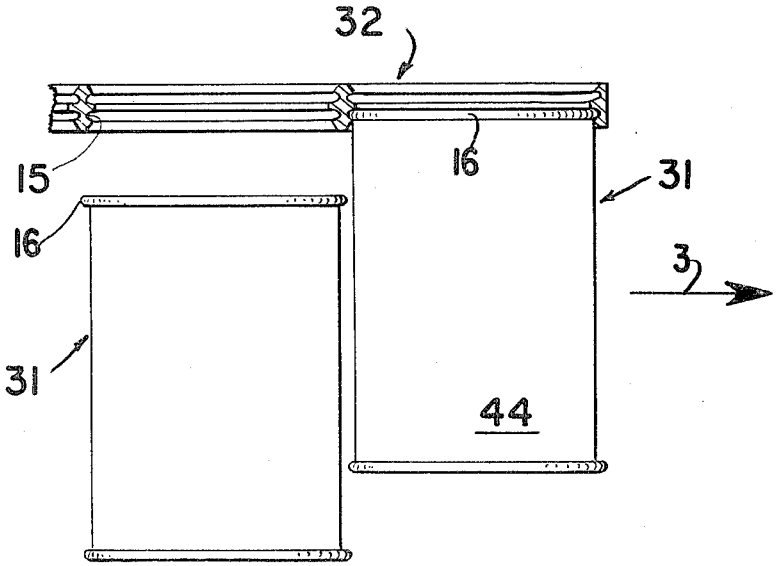
FIG. 5

METHOD AND DEVICE FOR THE INSERTION OF CANS INTO CARRIERS

FIELD OF THE INVENTION

The invention relates to a method for the packaging of a multiplicity of cans or similar rigid objects with a protuberant rim such as a circumferential projection or beaded edge by pressing them into carriers for engaging the rim or bead. Furthermore, the invention relates to equipment for the execution of the method.

BACKGROUND OF THE INVENTION

When pressing rigid objects such as food or drink cans into prefabricated holding devices provided with engaging formations it is necessary to overcome the radial forces which may lead to permanent deformation of the holding elements. This often prevents the devices from performing the function assigned to them, namely, the retention of the respective part pressed therein, for instance, at its beaded edge. The danger of such a permanent deformation increases when several cans are arranged in one plane next to each other and are pressed simultaneously into correspondingly adjacent engaging formations on the carrier.

OBJECTS OF THE INVENTION

It is an object of the invention to provide a method of packaging cans and similar objects into carriers and to provide the equipment for the execution of the method. The apparatus provides means to make it possible to press into the carriers continuously and successively cans or similar, rigid objects without incurring the danger of a permanent deformation while retaining the beaded edge of the cans securely in the carrier.

DESCRIPTION OF THE INVENTION

According to the invention, this problem is solved in that the cans, fed in one or more arrays, are pressed into the carriers in a synchronous manner and, in that, during the successive pressing operations, accomplished by means of ram means, pushing against the respective can bottoms, shaped cores conforming to the spaces between the cans are positioned into the interspaces therebetween, to properly align and buttress them during the pressing operation whereby the cans are engaged in the carriers.

Thus, according to the invention, the cans, preferably by means of a conveyor, moving synchronously with the carriers to be filled, the shaped aligning cores and the pressing rams, are fed to the carriers in one or more (juxtaposed) rows and are pressed into the respective carriers continuously but singly one after the other. Prior to the pressing operation the shaped cores are inserted, past the can bottom, into the interspaces or interstices between the cans. These position the cans relative to the carriers so that no undersirable deformation of the carrier frames can occur. The shaped cores should preferably be introduced to about two-thirds of the can height or dimension along the pressing direction. As the shaped core sections conform to the contour of the interspaces between the cans, proper alignment of the cans will result.

More particularly, the present invention relates to a method of packaging a plurality of objects having a protuberant beaded-rim into a plurality of discrete planar carriers, each having an array of bead-engaging formations, said method comprising the steps of sequentially grouping the objects into a packaging group arrayed identically to said array of formations; positioning said group in an insertion direction with said array of formations of one of said discrete carriers; aligning said objects in said group with respect to said formations by inserting lateral cores between the objects of said group; and individually displacing the objects in said group in said insertion direction toward, and into engagement of, said beads with the respective bead-engaging formations of said carrier while laterally buttressing and guiding said objects by said cores; as well as packaging apparatus for mounting objects having protuberant beaded rims into carriers bearing rim-engaging formations comprising conveyor means for grouping and moving the groups of said objects; positioning means for arraying said objects with respect to said carrier; a plurality of shaped lateral cores for aligning the rims of said objects with respect to said carrier formations; alignment means for inserting said cores between said objects in array for aligning and holding said rims with respect to said rim-engaging formations; synchronous ram means actuated by the position of said conveyor movements for displacing said aligned objects into the rim-engaging formations on said carrier.

By the method according to the invention, the carriers to be packaged or filled with the cans or similar objects with a protuberant rim or beaded edge can be inserted either from one side only, or also from both sides at the same time. In the first case it is expedient to proceed, preferably with vertical arrangement of the cans, by guiding the carriers by means of a synchronized conveyor belt, the latter serving to support the carriers during the successive can insertion operations.

If the carriers are to be mounted into both surfaces of carriers, according to U.S. Patent Application Ser. No. 938,249 filed Aug. 30, 1978, they may be inserted therein by pressing the cans simultaneously, staggered or rhythmically, into the mutually opposite carrier rim-engaging formations, a can can be engaged thereinto simultaneously without need for a separate counterforce at the back side of the carrier. The opposing insertion force stemming from this operation on the back side then serves to counter the simultaneous forces inserting the can on the front side of the carrier.

Furthermore, according to the invention, equipment for the execution of the method according to the invention comprises a conveyor bearing shaped cores introducible into the interstices between cans arrayed in one or more rows and with rams coordinated with the can bottoms.

At the end facing away from the cans, the shaped cores are supported by a first cam rail and the rams by a second cam rail. Means are provided for the simultaneous transport of the carriers to be filled. The first cam rail has a plateau, elevated in the insertion direction towards the cans with a relatively shallow incline and decline. The second cam rail has a hump, essentially located within the range of the plateau of the first cam rail and rising relatively steeply in the direction towards the cans over a distance corresponding approximately to the diameter of the can. The level of the plateau of the first cam rail should be above the normal rail level by about one-half to three-quarters, here two-thirds, of the can height.

It is an essential feature, among others, of the equipment according to the invention, that the first cam rail controlling the motion of the shaped cores has a plateau elevated in the insertion direction towards the can, and longer than the second cam rail controlling the motion of the rams for displacing and inserting the cans individually into the carriers.

Because the hump of the second cam rail raises the ram in a short path, preferably over a distance shorter than one can width, and by slightly more than the depth of the rim-engaging formation of the carrier, the rims of the cans are pressed singly and successively into the engaging frames of the carriers. After the engaging operation is completed, the rams and shaped cores are retracted by the declines in the cam rails. The cans mounted into the carriers are then transferred by a conveyor to a collecting point or packing station.

It may be advantageous for the insertion of two or more juxtaposed rows of cans into the appropriate carrier formations to stagger slightly from row to row the humps of the second cam rail controlling the respective insertion rams. They should be staggered preferably by about one can width, in the travel direction of the conveyor. The cans are then, seriatim, inserted in the carriers one after the other, but the insertion into two tangentially adjacent engaging formations of any carrier at the same time will not occur. Thus, the danger that undesired, permanent deformations exceeding the elastic limit of the materials forming the rim-engaging formations of the carriers is minimized.

Specific details and other embodiments of the method and according to the invention are described in conjunction with the following detailed description.

DETAILED DESCRIPTION

The details of the invention are described with reference to the Drawing wherein:

FIG. 4 shows a top view of a carrier to be filled by the method and apparatus of the invention; and FIG. 5 shows a section along line V—V of the carrier FIG. 4, with cans inserted into the rim-engaging formation thereof.

Figure 2:
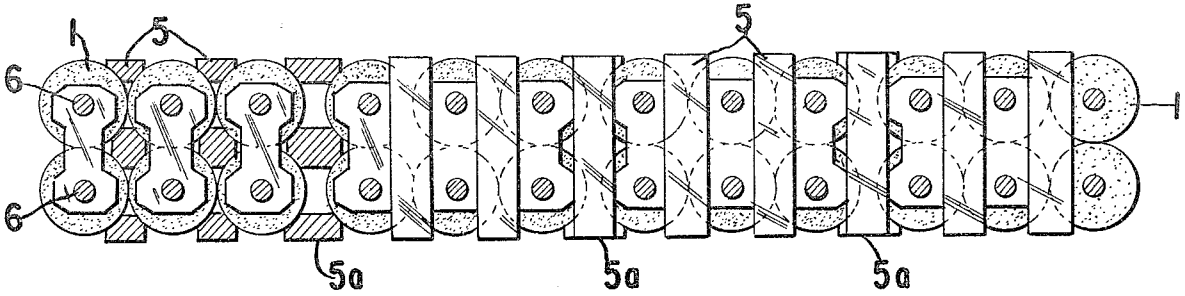
FIG. 2 shows a section along line II—II of FIG. 1.
Figure 1:
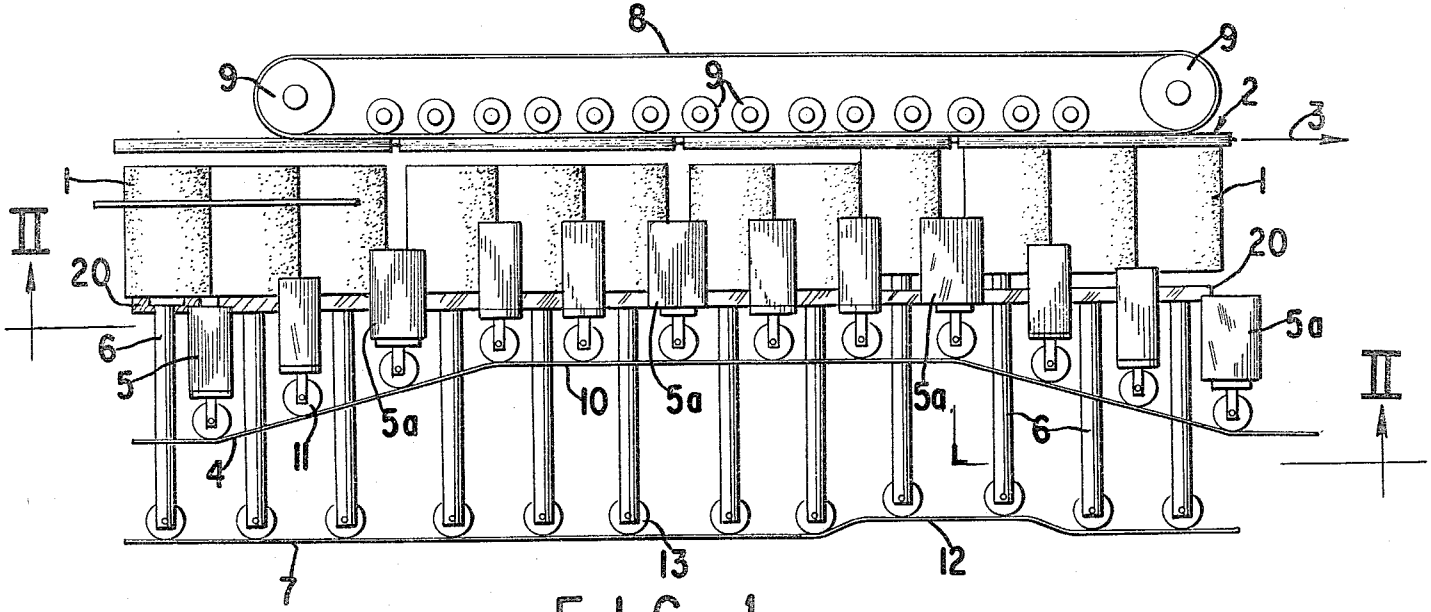
FIG. 1 shows an apparatus for the vertical insertion of the cans in a unilateral mounting of the cans on the carriers.

In the apparatus shown in FIGS. 1 and 2 for the packaging of a group of cans 1 with beaded edge in the carrier 2 of elastic, plastic material, the cans 1 are arrayed in one or more vertical rows and are transferred to a chain, belt or conveyor 20 running in arrow direction 3. In this embodiment the conveyor also bears shaped cores 5 which position, align and hold the cans 1. The cores 5 are controlled via a first can rail 4 so that the shaped cores 5 are inserted into interspaces or interstices around the cans standing in a row, past the can bottom, to about two-thirds of the can height in the insertion direction. The shaped cores 5 conform to the contour of the spaces between the cans and provide alignment of the cans with respect to the carriers 2.

The conveyor 20 also carries rams 6 which are pressing means positioned under each can bottom for providing insertion force to the cans 1 for pressing them into the rim-engaging formations on carriers 2.

According to this embodiment, the rams 6 are controlled by a second cam rail 7. As shown in FIG. 1, an upper belt 8, led across rolls 9, is provided to counter and hold the carrier against the pressures transmitted by the cans during the insertion operation.

The first cam rail 4 provided for the actuation of the shaped cores 5, has a plateau 10. Due to this plateau, the shaped cores 5 are gradually positioned into the spaces between the cans 1, prior to the start of the can-insertion operation. The shaped cores 5 are actuated by rolls 11 following along cam rail 4. The shaped cores 5 of course should conform to the contour of the interspaces between the sides of the cans. The cores 5*a* at the interspaces in the area between the cans 1 to be inserted along the edge between separate carriers 2 are bigger than the cores 5 within the array of cans within the same carrier. Consequently, the shaped cores 5*a* in the embodiment example are thicker than the other shaped cores 5.

The second cam rail 7, provided for the control of rams 6 in the area corresponding to the end of the plateau 10 of the first cam rail 4, is provided with a hump 12, the level of which relative to the normal level of the second cam rail 7 is sufficiently higher as to elevate rams 6 sufficiently along the insertion direction to introduce the cans 1 into the carriers 2. Staggered insertion of the cans into engagement with the formations on the carrier is accomplished by the hump 12 which rises above the usual level of the second cam rail 7 for a distance approximately the length of one can diameter. The rams 6 are guided and actuated by rolls 13 following along cam rail 7.

If carriers are to be filled with two or more lateral rows of cans, the humps 12 controlling the respective rams 6 can be mutually staggered in arrow direction 3, by about one can width.

Figure 3:
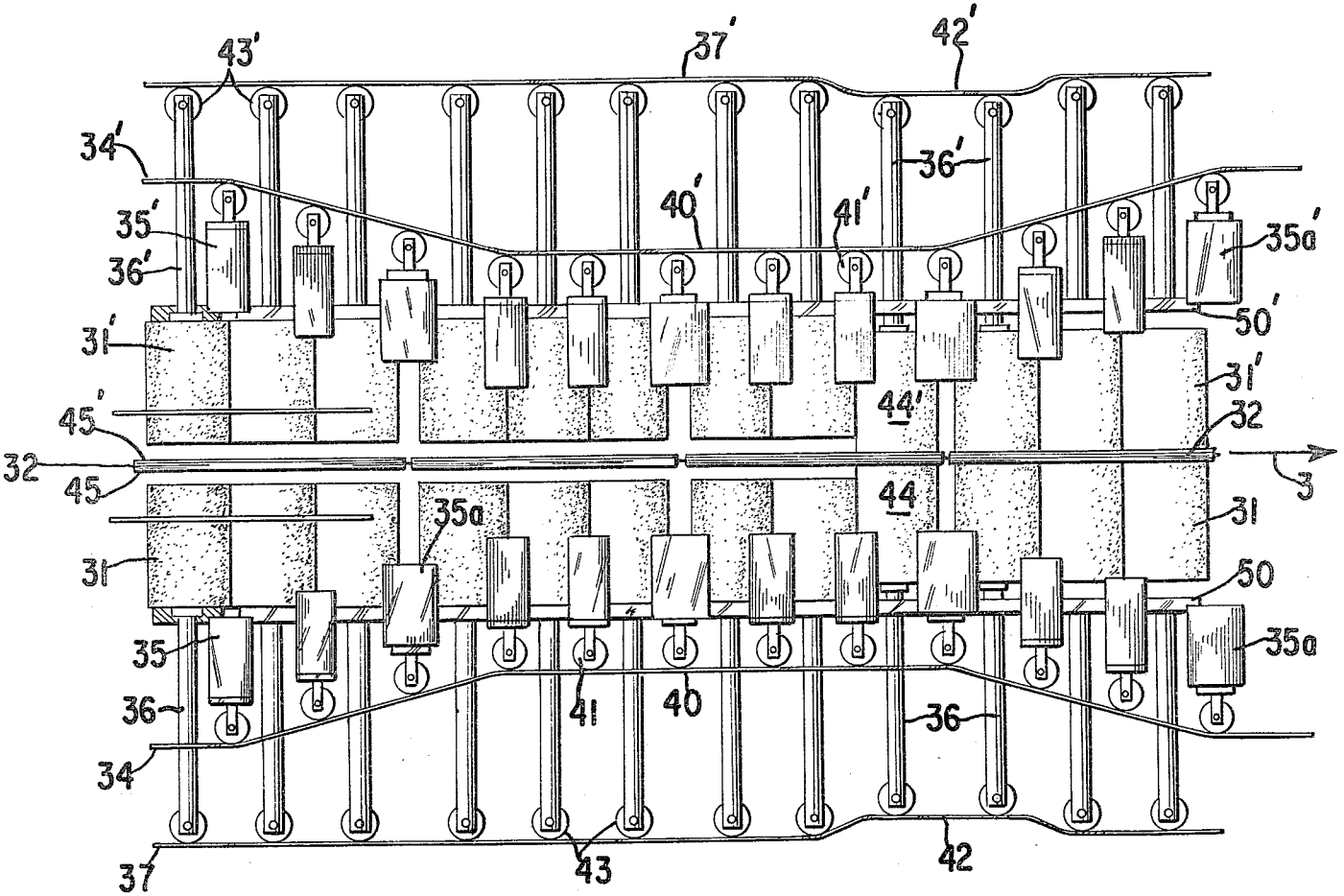
FIG. 3 shows the apparatus for the horizontal disposition of the cans and can insertion onto both sides of the carrier.

FIG. 3 shows an embodiment of apparatus according to this invention wherein two conveyors are each coordinated and disposed along mutually opposite surfaces of the carriers 32. The configuration of the conveyors is symmetrical relative to each conveyor so that the cans 31, and 31′ positioned by the shaped cores 35 and 35′ are each inserted simultaneously at 44 and 44′ into individual, exactly opposite frames of the carrier 32. In this embodiment the cans preferably are disposed horizontally on either side 45 and 45′ of the carrier 32, the insertion of the cans 31 and 31′ is thus performed without the use of a separate back-up conveyor because the cam rails 34 and 34′ and 37 and 37′ each have a plateau 40 and 40′ or a hump 42 and 42′ in exactly opposite positions or areas. The two parts of the equipment according to FIG. 3 are otherwise symmetrically designed exactly like the equipment according to FIGS. 1 and 2, including provision for cores 35 and 35′ as well as rams 36 and 36′ and their respective follower rolls 41, 41′, 43 and 43′.

FIG. 4 shows a top view of a carrier 2 to be filled, by the apparatus of this invention. A section along line V—V of FIG. 4 is shown in FIG. 5. FIG. 5 also shows how the cans 1 are engaged by their rims 16 in the carrier 2. The frame of carrier 2 consists of rim-engaging annular holding formations 15 whose inside wall conforms to beaded edge rim 16 of the cans 1. Such a type of carrier 2 is disclosed in copending U.S. Patent Application Ser. No. 938,249, filed Aug. 30, 1978, and entitled "Sealing Carrier Pack For Cans With Beaded Edge". Bridges 17 are provided in the places where the annular holding devices 15 adjoin as reinforcements.

For better illustration, FIG. 5 shows a can 31 before its insertion and a can 31 after its insertion into the rim-engaging formation 15 of the carrier 32 according to position 44 and 44' shown in FIG. 3. When pressing the cans 1 or 31 into the carrier 2 or 32, the outer edges of the rim-engaging formations 15 must be temporarily elastically deformed. By means of the present invention, the cans are pressed into the rim-engaging formations 15 singly, one after the other, while aligned and positioned, by means of the shaped cores 5, 35 and 35' precisely with respect to the carrier plane, the rim-engaging formations 15 deflect laterally and elastically during the insertion operation so that a permanent deformation will not be caused. Only after the preceding can is seated firmly in the carrier 2 or 32 and the formation 15 of a plastic, elastic material has engaged the beaded rim edge 16 of the can, is the next can pressed or inserted into the carrier 2 or 32.

The carriers 2 or 32 in either the device of FIGS. 1 and 2, or FIG. 3 are conveyed by the conveyors 20 or 50, 50' at the same rate in direction of the arrow 3 as the cans 1 or 31.

The preceding specific embodiments are illustrative of the practice of the invention. It is to be understood however, that other expedients known to those skilled in the art or disclosed herein, may be employed without departing from the spirit of the invention or the scope of the appended claims.

We claim:

1. A method of packaging a plurality of objects having a protuberant beaded-rim into a plurality of discrete planar carriers, each having an array of bead-engaging formations disposed on opposite sides of the plane of said carrier, each bead-engaging formation comprising a resilient socket adapted to engage the protuberant beaded-rim of said objects, said method comprising the steps of sequentially grouping the objects into two packaging groups arranged identially to said array of bead-engaging formations disposed on opposite sides of the plane of said carrier; positioning said packaging groups in an insert direction with said array of bead-engaging formations of one of said discrete carriers; aligning said objects in each of said packaging groups with respect to said bead-engaging formations by inserting lateral cores between the objects of each of said packaging groups; and individually displacing the objects in each of said groups in said insertion direction on each side of said carrier toward and into engagement of said protuberant beaded-rim with the respective bead-engaging disposed on opposite sides of the plane formation of said carrier while laterally buttressing and guiding said objects by said cores, whereby said objects on each side of said carrier are simultaneously engaged with the respective bead-engaging formations.

2. The method according to claim 1 wherein said displacement of said objects is by cam-actuated rams.

3. The method according to claim 1 wherein said lateral cores are disposed and positioned into the interstices between said objects to about two-thirds of the height of said objects.

4. The method according to claim 1 wherein said steps of sequential grouping, positioning, aligning and displacing are performed during synchronous movement of said objects and said carrier perpendicular to said insertion direction.

5. Packaging apparatus for mounting objects having protuberant beaded rims into carriers bearing rim-engaging formations comprising a resilient socket adapted to engage the protuberant beaded rim of said objects comprising conveyor means for grouping and moving the groups of said objects arrayed with respect to said carrier, a plurality of shaped lateral cores for aligning the rims of said objects with respect to said rim-engaging formations; alignment means for inserting said cores between said objects in array for aligning and holding said rims with respect to said rim-engaging formation; individual ram means for displacing said objects in the direction of said carriers, and means actuated by the position of said conveyor movements for moving said ram means to displace said aligned objects having protuberant beaded rims into the rim-engaging formations on said carrier.

6. The apparatus according to claim 5 wherein said shaped cores are actuated by a cam-rail having an elevated plateau for inserting said cores at a station on said conveyor and said ram means are advanced in an insertion direction by a ram-follower actuated by a hump along said conveyor positioned at an interval along said elevated plateaus so that said engagement of said object having protuberant beaded ring with said rim-engaging formation occurs while said objects are laterally buttressed and supported.

7. The apparatus according to claim 6 wherein said plateau rail actuates the insertion of said cores between said objects to a distance of substantially two-thirds the dimension of said objects in the displacement direction.

8. The apparatus according to claim 5 wherein said displacement of said objects is in a vertical direction and said carrier is supported against said displacement by rigid support means.

9. The apparatus according to claim 5 wherein said displacement is in a horizontal direction and said carrier is supported against displacement by a second series of conveyor means, positioning means, shaped lateral cores, alignment means and synchronous ram means.

10. The apparatus according to claim 9 wherein said carrier is fitted with said rim-engaging formations on opposite sides thereof and said apparatus comprises two conveyors oppositely disposed with said carriers transported therebetween so that said objects are simultaneously inserted and engaged into both sides thereof after alignment by said cores.

* * * * *